US011602651B2

(12) United States Patent
Harzfeld

(10) Patent No.: US 11,602,651 B2
(45) Date of Patent: Mar. 14, 2023

(54) METHOD FOR PREVENTING FIRES IN TANK SYSTEMS AND TANK SYSTEM FOR METHANOL FUELS COMPRISING A FIRE PROTECTION APPARATUS

(71) Applicant: Edgar Harzfeld, Stralsund (DE)

(72) Inventor: Edgar Harzfeld, Stralsund (DE)

( * ) Notice: Subject to any disclaimer, the term of this patent is extended or adjusted under 35 U.S.C. 154(b) by 136 days.

(21) Appl. No.: 16/979,897

(22) PCT Filed: Mar. 8, 2019

(86) PCT No.: PCT/EP2019/055853
§ 371 (c)(1),
(2) Date: Sep. 11, 2020

(87) PCT Pub. No.: WO2019/175050
PCT Pub. Date: Sep. 19, 2019

(65) Prior Publication Data

US 2021/0052926 A1 Feb. 25, 2021

(30) Foreign Application Priority Data

Mar. 12, 2018 (DE) ..... 10 2018 105 642.7

(51) Int. Cl.
*A62C 3/06* (2006.01)
*A62C 3/07* (2006.01)

(52) U.S. Cl.
CPC ..... *A62C 3/065* (2013.01); *A62C 3/07* (2013.01)

(58) Field of Classification Search
CPC ..... A62C 3/065; A62C 3/07
USPC ..... 169/43–45, 66
See application file for complete search history.

(56) References Cited

U.S. PATENT DOCUMENTS

| | | | | |
|---|---|---|---|---|
| 1,876,425 | A | 9/1932 | King | |
| 2,718,330 | A | 9/1955 | Adamson | |
| 4,880,135 | A | 11/1989 | Neou | |
| 5,163,517 | A | 11/1992 | Kozai et al. | |
| 6,849,194 | B2 * | 2/2005 | Robin | C07C 43/12 568/683 |
| 2007/0111060 | A1 | 5/2007 | Hoffjann et al. | |

FOREIGN PATENT DOCUMENTS

| | | | |
|---|---|---|---|
| CN | 105258148 | A | 1/2016 |
| DE | 4118026 | C2 | 10/1994 |
| DE | 10352569 | A1 | 6/2005 |
| DE | 102005054885 | | 12/2007 |
| DE | 102018105643 | | 5/2019 |
| GB | 2511459 | A | 9/2014 |
| WO | 9523749 | A1 | 9/1995 |
| WO | 2009070939 | A1 | 6/2009 |

* cited by examiner

*Primary Examiner* — Christopher S Kim
(74) *Attorney, Agent, or Firm* — Smartpat PLC

(57) ABSTRACT

A method for preventing fires in tank systems and tank systems for methanol fuels comprising a fire protection apparatus are disclosed. The method can be effectively implemented to prevent vehicle fires, and to provide tank systems for methanol fuel with an appropriate fire protection apparatus. The method for preventing fires in tank systems is used, for example, in vehicles having a drive using a methanol-based fuel. An incombustible mixture of methanol and water being produced in an emergency. The tank systems contain at least one double-layer tank and/or at least one bell tank and/or at least one bellows-type tank.

17 Claims, 9 Drawing Sheets

METHOD FOR PREVENTING FIRES IN TANK SYSTEMS AND TANK SYSTEM FOR METHANOL FUELS COMPRISING A FIRE PROTECTION APPARATUS

TECHNICAL FIELD

The disclosure relates to a method for preventing fires in tank systems and to tank systems for methanol fuels with a fire protection apparatus.

BACKGROUND

Climate change and rising oil prices are increasingly leading to a rethink of the use of fossil fuels. In particular, research is being conducted in the field of alternative drives to find suitable replacements. For example, methanol fuels are a possible energy source for use in tank systems, similar to those known from gas and diesel engines.

In addition to functionality, the safety and ability to control such technology plays a decisive role. One of the main causes of vehicle fires is damage to the tank and fuel lines, such that leaking fuel can become an enormous source of danger. It is therefore necessary to extinguish fires rapidly or not to let them start at all. For this reason, various extinguishing devices are already mandated, for example in motor vehicles. Powder extinguishers for being able to fight fires on site as rapidly as possible, for example, are known. Automatic fire extinguishing systems based on $CO_2$ or powder are also already available.

A completely different solution is disclosed in DE 103 52 569 A1, with which the combustible fuel cannot ignite in a fire. For this purpose, a fuel container is protected against fire by means of an intumescent mass installed between two container shells.

The solution in the German patent DE 41 18 026 C2 describes a solenoid valve installed in the fuel line, which prevents fuel from escaping. At the same time, extinguishing agent is introduced through elastic conduits at critical zones.

DE 41 18 026 C2 discloses a device for preventing a fire in motor vehicles arising in the event of a malfunction, with which the fuel escaping under high pressure from a damaged (for example, ruptured) fuel line is immediately and automatically withdrawn with the aid of a collecting container charged with negative pressure, so that the ignition of the escaping fuel is effectively prevented. The vacuum container is connected to the fuel line via a solenoid valve. In the event of danger, the solenoid valve is automatically controlled such that, in the event of danger, the fuel line is immediately emptied, thus preventing fuel from igniting in the ruptured fuel line.

Other systems work with a protective gas, which can prevent a fuel tank from exploding. In the solution according to DE 10 2005 054 885 B4, the exhaust gas generated by the fuel cell during the operation of the fuel cell system is used as a protective gas.

An additional possibility for preventing fires is shown in CN 105 258 148 A. A liquid fuel tank, for example for methanol, is arranged in a water tank and is almost completely surrounded by the water. A fuel line is guided to the combustion engine via a three-way valve. At the same time, a line for the water in the water tank is connected to the three-way valve. An electromagnetic valve control unit normally opens the fuel line. However, if a fire breaks out, the water line is opened so that the fuel in the fuel line mixes with the water.

WO 95/23 749 A1 discloses a storage container for highly flammable liquids such as alcohol. This storage container is arranged in a water tank, which is surrounded by a stable tank. Such tank can also be buried in order to form a three-wall system that provides special protection against loss through evaporation, against contamination of air, soil and groundwater, and protection against fire and explosion.

A device to prevent the fire risk of vehicles is shown in WO 2009/070 939 A1. The device comprises a fire extinguishing unit with a switch assembly. The switch assembly is connected in parallel with the airbag actuation. If the airbag is triggered in the event of a collision or self-ignition, an extinguishing agent is introduced via a conduit onto the engine or into the fuel tank. The fire extinguishing unit can also be operated manually.

GB 2 511 459 A discloses a device for inerting fuel in a fuel system with a container located inside the fuel system. The container contains a chemical that, when mixed with the fuel contained in the fuel system, renders the fuel inert.

U.S. Pat. Nos. 4,880,135 A and 1,876,425 A show different solutions for bellows assemblies on or in containers with highly flammable liquids and U.S. Pat. No. 2,718,330 A discloses an inert gas bell inside a container with a highly flammable liquid.

Backup power systems are already being used today to prevent power failures within sensitive consumer groups. These include, in particular, residential areas, industrial parks, schools, hospitals, food markets, cold stores, sports stadiums, water supply facilities and retirement homes. Such consumers usually have an emergency power generator that is operated by a diesel engine.

Backup power systems under the prior art are characterized in that that they can only safeguard emergency operation, which provides for emergency lighting and/or emergency operation of technical systems, for example the pump operation, of a pumping station. Backup power systems under the prior art are not capable of delivering electricity, heat and fuel. Such additional functions are new.

SUMMARY

The object of the disclosure is to develop a method that can be used effectively to prevent vehicle fires. Furthermore, it is the object of the disclosure to provide tank systems for methanol fuels with a suitable fire protection apparatus.

The object is achieved by the features as claimed.

The method for preventing fires in tank systems is used, for example, in vehicles with a methanol-based drive system as the fuel. In an emergency, a mixture of methanol and water incapable of being ignited is produced.

The method uses a fire protection apparatus that includes at least one methanol tank with methanol and at least one separate water tank with water. By means of a control signal from at least one airbag system and/or at least one fire warning system, water is released from the at least one water tank into the methanol or methanol is released from the at least one methanol tank into the water, resulting in a water-methanol mixture, whose material properties fall below an effective ignition limit.

The method is further carried out in that, at the same time that the at least one airbag system and/or at least one fire warning system is triggered, the control signal is sent to a receiver of a control and activation unit of the tank system. The tank system consists of a double-layer tank, in which the water tank is arranged in the upper half of the methanol tank. At least two bulkhead triggering units with integrated bulkheads are in operative connection with both the methanol tank and the water tank. At least one punch triggering unit is also in operative connection with the water tank. The bulkhead triggering units and the punch triggering unit are activated by the control signal, by which water from the water tank is led into the methanol tank by means of open bulkheads.

The method is further carried out in that, when the bulkhead triggering units are activated by the integrated bulkheads, the water tank is opened, wherein the water flows into the methanol tank. At the same time a flat, horizontal rubber membrane, which divides the water tank into two areas and is movably arranged in the water tank and connected to the punch triggering unit, is pressed against the tank bottom of the water tank by the punch triggering unit, in order to accelerate the outflow of the water. The bulkheads seal the water tank in the direction of the methanol tank and the rubber membrane is relaxed during operation.

The method is further carried out in that, at the same time that the at least one airbag system and/or at least one fire warning system is triggered, the control signal is sent to a receiver of a control and activation unit of the tank system, wherein the tank system consists of a bell tank that comprises the methanol tank. The methanol tank is arranged in the water tank. A water bell, which is filled with water, has a connection to the water tank. The water bell is arranged as a vertically oscillating system in the methanol tank in a vertically movable manner. The control signal activates a fixing and triggering system to direct the water from the water tank and water bell into the methanol tank. The water bell is guided in the middle, along a tube centering device, which is firmly connected to the tank bottom of the water tank and the bottom of the methanol tank. The water bell moves vertically in the methanol tank. A return spring between a tank cover plate of the methanol tank and the upper side of the water bell causes the water bell to vibrate vertically along the tube centering device when the fixing and triggering system is activated.

The method is further carried out in that, at the same time that the at least one airbag system and/or at least one fire warning system is triggered, the control signal is sent to a receiver of a control and activation unit of the tank system. The tank system consists of a bellows-type tank that comprises an upper bellows as a water tank with water, the methanol tank with methanol, and a lower, contracted bellows. The upper bellows, the methanol tank, and the lower bellows are arranged one above the other with a bellows connecting tube in an operatively connected manner. An airbag triggering unit arranged on an upper side of the water tank and an airbag triggering unit arranged on a lower side of the methanol tank are activated to direct the water from the water tank and the water bell into the methanol tank. After activation of the airbag triggering unit, the lower bellows is released by moving the bellows connecting tube in the direction of the lower bellows, wherein at least two openings between the water tank and the methanol tank and at least two feedthroughs between the methanol tank and the lower bellows are released, such that water flows from the upper bellows into the methanol tank, mixes with the methanol and flows as a water-methanol mixture into the lower bellows.

The method is further carried out in that, at the same time that the at least one airbag system and/or at least one fire warning system is triggered, the control signal is sent to a receiver of a control and activation unit of the tank system, by which, in a backup power system, at least one double-layer tank and/or at least one bell-type tank and/or at least one bellows-type tank is activated, in order to direct the water from the water tank or from the water tank and the water bell into the methanol tank.

The object is also achieved by a tank system for methanol fuels with a fire protection apparatus, which contains at least one methanol tank with methanol and at least one separate water tank with water. The water tank is arranged in the upper half of the methanol tank and, together the methanol tank and water tank, form a double-layer tank. At least two bulkhead triggering units with integrated bulkheads are in operative connection with both the methanol tank and the water tank. A punch triggering unit is also in operative connection with the water tank. The bulkhead triggering units and the punch triggering unit are connected to a control and activation unit. A flat rubber membrane divides the water tank into two areas and is movably arranged in the water tank and is connected to the punch triggering unit. The bulkheads seal the water tank in the direction of the methanol tank and the rubber membrane is relaxed during operation. For the purposes of the disclosure, an operational case is to be understood as the normal application, not the event of a breakdown.

The object is also achieved by a tank system with a fire protection apparatus, which contains at least one methanol tank with methanol and at least one separate water tank with water. The methanol tank is arranged in the water tank in such a manner that the methanol tank is surrounded by the water. A water bell filled with water is, on its part, arranged in the methanol tank and connected to the bottom of the methanol tank in a sealed manner. The water bell has an open connection to the water tank by means of feedthroughs in the bottom of the methanol tank. The water bell is arranged in a vertically movable manner along a tube for water filling and venting in the methanol tank. A fixing and triggering system is connected to a control and activation unit. The fixing and triggering system is connected to the water bell via the tube for water filling and venting. In the tube for water filling and venting, a tube centering device is firmly connected to the tank bottom of the water tank and to the bottom of the methanol tank, such that the water bell is guided in the middle. A return spring is arranged between a tank cover plate of the methanol tank and the upper side of the water bell.

The object is also achieved by a tank system with a fire protection apparatus, which contains at least one methanol tank with methanol and at least one separate water tank with water. The methanol tank is connected to the water tank via a bellows system, thus forming a bellows-type tank. The bellows-type tank is guided in a housing. The water tank is arranged in an upper bellows, above the methanol tank, and a lower bellows is arranged below the methanol tank; these are tensioned during normal operation and relaxed after triggering. A bellows connecting tube connects the lower bellows with the upper bellows. Between the water tank and the methanol tank, there are at least two openings, which are closed by a sealing plate during operation. Between the methanol tank and the lower bellows, there are at least two feedthroughs, which are sealed by a removable cover plate of the lower bellows. An airbag triggering unit and water filling system, which is arranged at an upper side of the water tank, and an airbag triggering unit and water-methanol mixture discharge system, which is arranged at a lower side of the methanol tank, are connected to each other and to a control and activation unit via the bellows connecting tube. The sealing plate is firmly connected to the bellows connecting tube, which allows the airbag triggering units to release the openings in the event of fire. The methanol tank is arranged in a housing that, in its extension above and below the methanol tank, presents a bellows guide for the upper bellows and the lower bellows. The sealing plate is firmly connected at its lower side with a return spring, which is firmly connected at its opposite end to the tank bottom of the methanol tank.

The object is also achieved by a tank system that is connected to a backup power system for converting and storing electrical energy into chemical energy by means of a methanol storage unit, wherein the tank system contains at least one double-layer tank and/or at least one bell tank and/or at least one bellows-type tank, wherein water obtained from exhaust gas from a gas turbine is fed to the water tank of the tank system via a water separator of the backup power system.

The following problems are solved by the invention:

1) Ensuring of a gradual transition from oil-based to hydrogen-based fuels by exploiting all system advantages (for example, water miscibility of methanol).

2) Prevention of vehicle fires due to tank or fuel line damage with fuel leakage by adding water to the fuel to keep it below the ignition limit.

3) Non-destructive and short-term restoration of the full functionality of the tank system after response and effectiveness of the fire protection apparatus through the resetting and filling of the chamber with water.

4) Extension of existing airbag systems for personal protection with a tank protection system, which prevents vehicle fires from occurring after the response of the airbag system.

The advantages of the invention are that neither the vehicle driver nor other parties involved have to extinguish a fire, as it is prevented from developing. The fire protection works at the source in the tank, so to speak. The solution can be implemented with little technical effort.

An additional advantage is the non-destructive restoration of the functionality of the tank system after response and activation since the tank itself is not damaged. Since the tank system proposed here only needs to be newly pre-tensioned and filled with water, it can be used as often as required.

As alternative fuels are becoming more and more important, it is a particular advantage if the safety of the vehicles can be increased. The disclosure can be used both in the field of motor vehicles and for construction or agricultural machinery. A modified application on ships, railways or aircraft would also be conceivable.

The backup power system in accordance with the disclosure can provide large capacities for an almost unlimited period of time. The storage required for this purpose (methanol tank) is very cost-effective and superior to current battery solutions in all respects. In addition, the backup power system can be operated in hot standby mode by means of a reformer (methanol to hydrogen and $CO_2$) with very rapid reaction times and with continuous heat production for optional heat extraction, by which very rapid load changes can be realized. Since the backup power system draws electrical energy from the supplying grid (generation grid) without interruption until the grid is interrupted, the system can also take on additional functions. These include, for example, a start-up aid for wind farms and a filling station function for self-produced methanol.

BRIEF DESCRIPTION OF THE DRAWINGS

The invention is explained in detail by means of drawings. The following are shown.

DETAILED DESCRIPTION

Various exemplary embodiments are shown. The reference signs are the same in all exemplary embodiments, provided that the same parts are named. In addition to a methanol tank 106 for methanol 6 and a water tank 107 for water 7, a control and activation unit along with supply and discharge lines, for example for methanol 6 and water 7, are also connected to the tank system. The control and activation unit is in operative connection with an airbag and/or fire warning system not shown here, and receives its control signals. During normal operation, the methanol tank 106 is filled as usual. If, for example, the airbag system or the fire warning system is triggered in an accident or breakdown, a signal is forwarded to the receiver of the control and activation unit.

Double-Layer Tank

Figure 1:
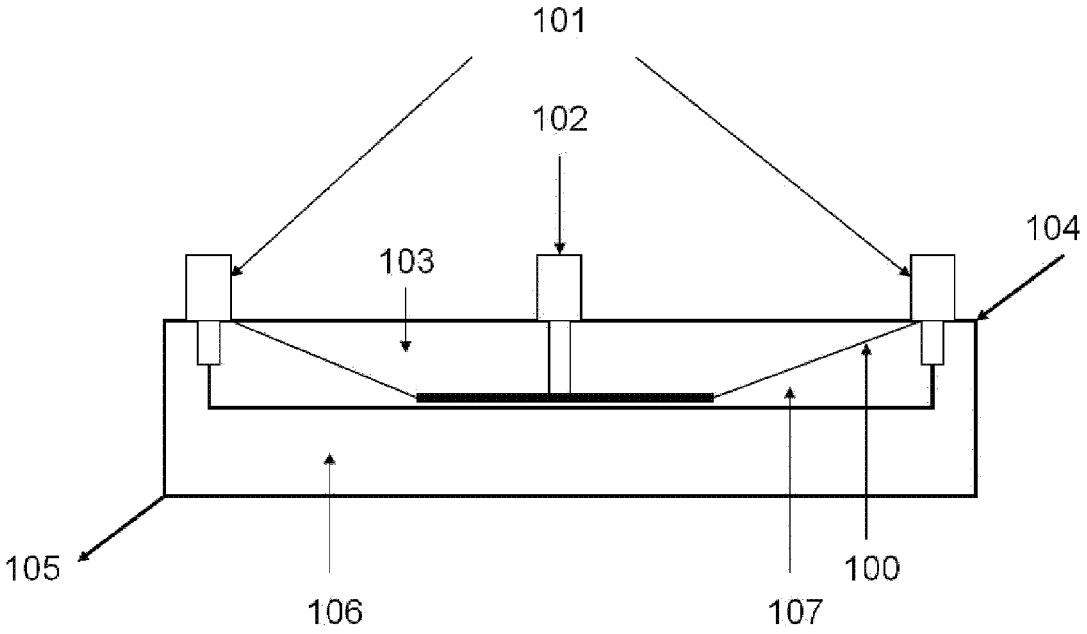
FIG. 1: a tank system (double-layer tank) after a triggering.

FIG. 1 shows a tank system with a deactivated fire protection apparatus after a triggering. By means of two triggering units connected to an airbag system, two closed bulkheads of the water tank 107 are opened in an emergency, allowing water 7 or a water-methanol mixture 76 (anti-freeze measure) to enter the methanol tank 106. A third triggering unit uses a water airbag, which helps to ensure that water 7 can reach the methanol tank 106 very rapidly. The water 7 or the water-methanol mixture 76 mixes with the methanol 6 contained in the methanol tank 106 and helps to reduce the ignition capacity of the mixture to such an extent that the resulting mixture cannot cause a fire. After the triggering of an airbag, the water-methanol mixture 76 can be removed via a separate valve on the methanol tank 106 and the tank can be flushed.

The tank system according to FIG. 1 essentially consists of a methanol tank 106, a water tank 107, two bulkhead triggering units 101 with integrated bulkheads, a punch triggering unit 102 with a punch and a flat rubber membrane 100, which divides the water tank 107 into two areas and is movably arranged in the water tank 107, an air chamber 103 above the rubber membrane 100, a methanol feed 104 and a methanol discharge 105. The bulkhead triggering units 101 and the punch triggering unit 102 are in operative connection with a control and activation unit of the tank system.

The methanol tank 106 is empty in this illustration. All triggering units, here the bulkhead triggering unit 101 and the punch triggering unit 102, have responded and are in the safety stop position, which is equivalent to a tension-free state. The bulkheads of water tank 107 are open. The water 7 previously contained in it was led into the methanol tank 106 where it mixed with methanol 6. The mixture has fallen below the ignition limit and has prevented a vehicle fire. The water-methanol mixture 76 was subsequently pumped out via the methanol discharge 105.

In the methanol tank 106, the water tank 107 has been integrated in such a manner that, in the event of "airbag triggering," a control signal is sent to the receiver of the control and activation unit of the tank system and water 7 is led from the water tank 107 into the methanol tank 106 by means of open bulkheads. The bulkheads are opened by bulkhead triggering units 101, which are connected to the airbag system and/or the fire warning system (in short: airbag system). At the same moment, the airbag system activates the punch triggering unit 102 with the punch and the rubber membrane 100, which presses the punch against the tank bottom of the water tank 107 by means of a pre-tensioned spring. The water airbag contained in the water tank consists of a rubber membrane 100 attached to the edges of the tank cover of the water tank 107, in the middle of which a flat punch is placed, which ensures that the rubber membrane 100 can be pressed flat, around the circumference of the punch surface, from the tank cover in the direction of the water tank bottom. This makes it possible to transport a very large amount of water 7 from the water tank 107 to the methanol tank 106 in a very short time. The combination of the punch and the rubber membrane 100 takes up approximately ⅔ of the total volume of the water tank 107. By activating the punch triggering unit 102, the water tank 107 is emptied abruptly by up to ⅔ of its volume.

Figure 2:
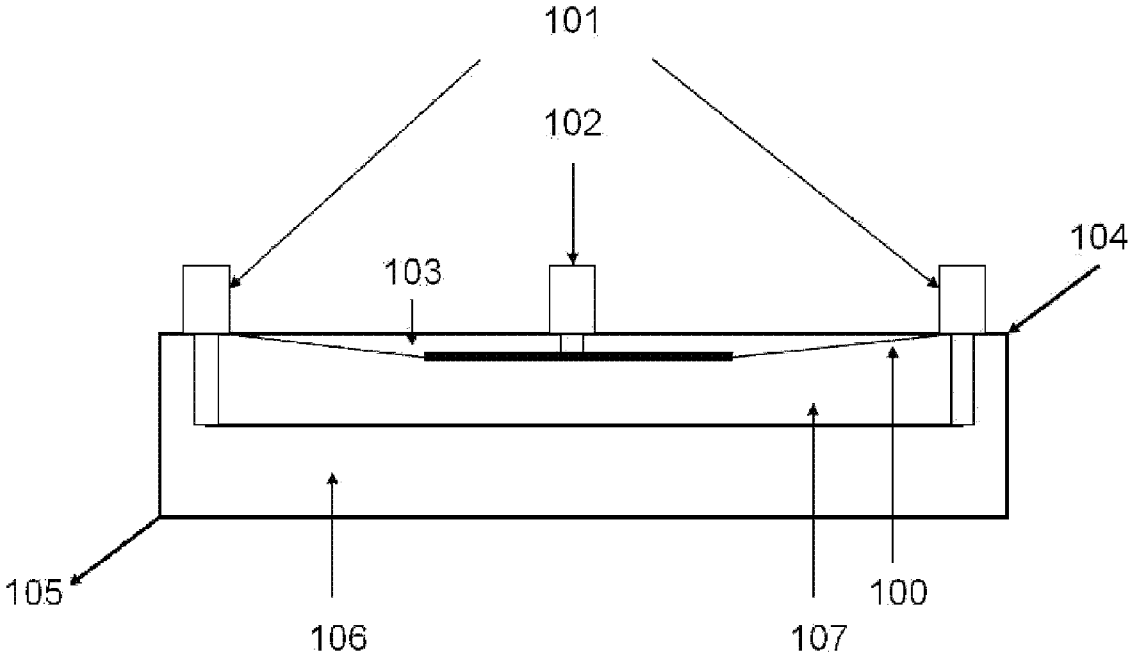
FIG. 2: a tank system (double-layer tank) prior to filling.

FIG. 2 shows the tank system in a preliminary operational state. The state is preliminary, because the water tank 107 has not yet been filled with water 7. To restore the functional operability of the double-layer tank and its protection devices, the lateral bulkheads of the bulkhead triggering unit 101 are closed. The water airbag is tensioned and the water tank 107 is filled. The protection device is now prepared for a new use. The methanol tank can now be easily filled (refueling) or emptied (fuel delivery to the engine). The punch of the punch triggering unit 102 is pre-tensioned and ready for a triggering.

Figure 3:
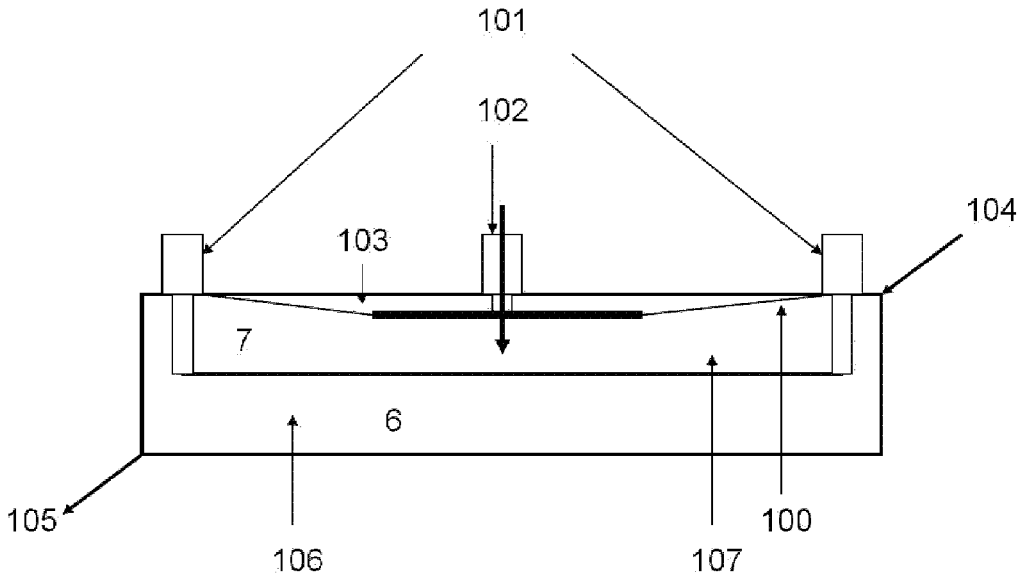
FIG. 3: a tank system (double-layer tank) during filling.

FIG. 3 shows the tank system while filling the water tank 107 with water. The water filling is carried out via the punch triggering unit 102. After filling the water tank 107, the water feed of the punch triggering unit 102 is sealed tightly and the airbag system is made fully operational. The fire protection apparatus is reusable, since no destruction of the fire protection apparatus takes place.

Leaks in the bulkheads of the double-layer tank are very unlikely. If leaks were to occur, a level control by means of a metal-coated buoyancy body filled with air in a measuring tube would lead to an interruption of contact (two contacts on the water tank cover are connected by means of a buoyancy body) and signal the leakage. In the event of leakage, the tank must be checked, and the bulkheads must be replaced.

Bell Tank

Figure 4:
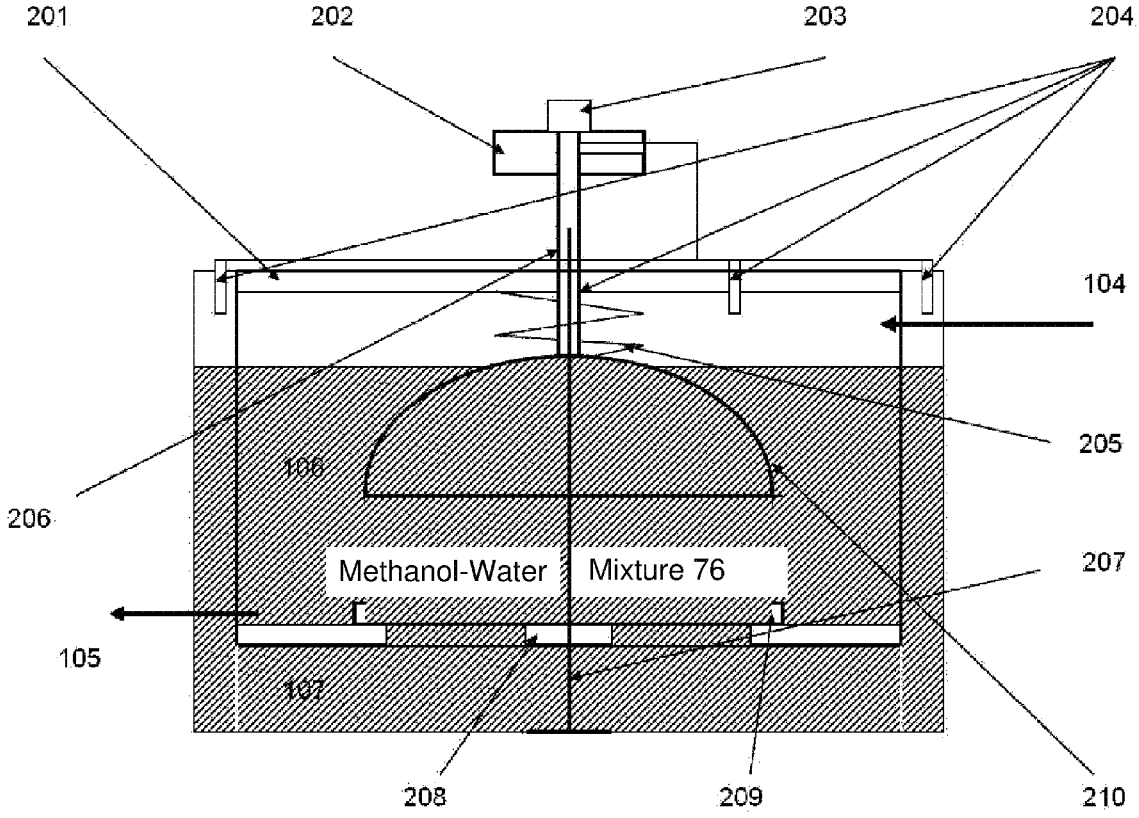
FIG. 4: a tank system (bell tank) after a triggering.
Figure 5:
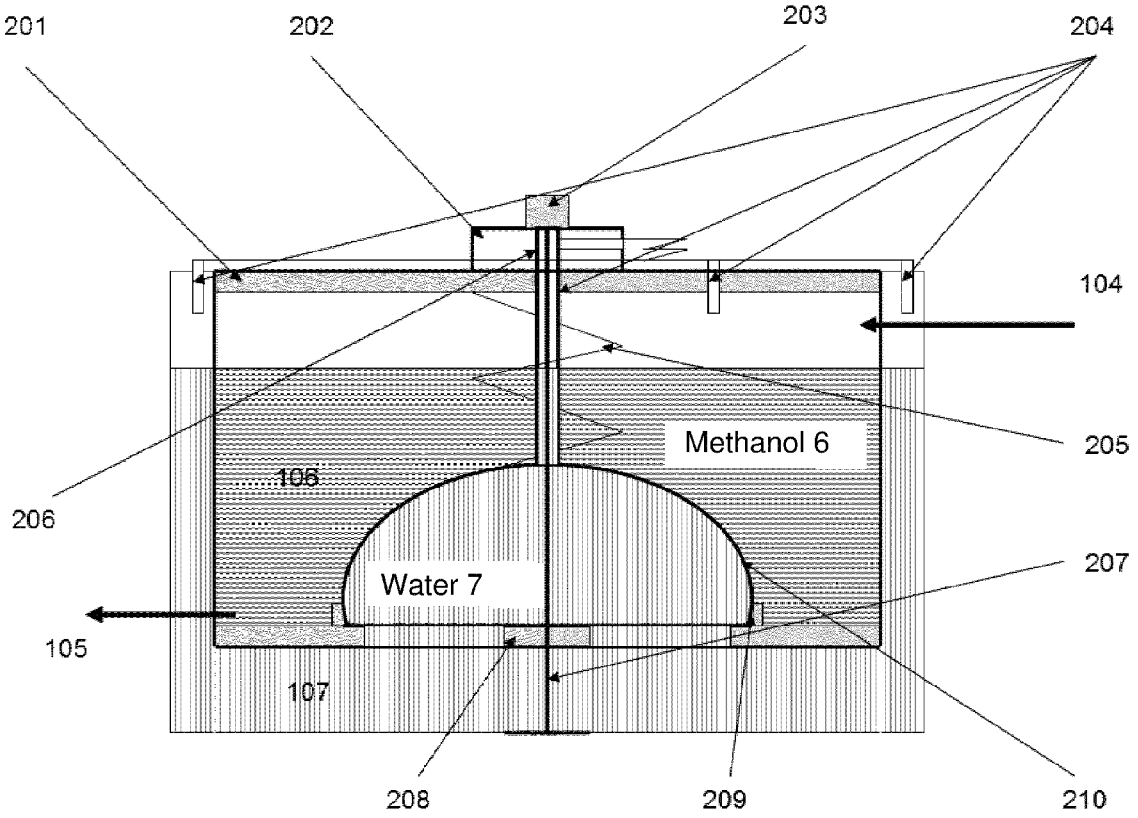
FIG. 5: a tank system (bell tank) in operation.

An additional exemplary embodiment is shown in FIGS. 4 and 5. FIG. 4 shows the tank system after the triggering of the airbag system.

A methanol tank 106 is located in a water tank 107. By means of a water bell 210, feedthroughs in the methanol tank 106 are opened in the direction of the water tank 107, such that water 7 can enter the methanol tank 106 and a water-methanol mixture 76 arises, which causes the mixture to fall below the ignition limit of pure methanol 6 and prevents a fuel fire.

The methanol tank 106 is equipped with a tank cover plate with stiffeners 201 that ensure that the airbag system, which is in operative connection with the control and activation unit of the tank system, can control a fixing and triggering system 202. The water is fed to the water tank 107 via an open sealing cap for water feed and pressure relief 203. The pressure equalization system 204 ensures that the desired mixing process of water 7 and methanol 6 into a water-methanol mixture 76 can take place very rapidly.

The water bell 210 in the methanol tank 106 is connected to the airbag control and the fixing and triggering system 202 via a rigid tube connection, namely a tube for water filling and venting 206. A tube centering device 207 is connected in the rigid tube connection, tube for water filling and venting 206. The tube centering device 207 is firmly fixed to the tank bottom of the water tank 107 and to the bottom of the methanol tank 106 (tank bottom 208 with stiffening), and thus guarantees that the water bell 210 is always centered. A return spring 205 for the water bell 210 is installed between the water bell 210 and the tank cover plate 201 with stiffeners. The water bell 210 is thereby pressed onto the methanol tank bottom by a return spring 205. In order to prevent water 7 from escaping from the water bell 210, the water bell 210 is fixed in a sealing ring on the methanol tank bottom. The return spring 205 for the water bell 210 is relaxed after a triggering.

A tube centering device 207 is attached to the water tank bottom, which ensures that the water bell 210 can take up a precise position. The tube centering device 207 is located in a mounting and supply tube. The mounting tube is used to fasten the water bell 210. In addition, the mounting tube is also used for water supply, water filling and the necessary pressure equalization of the water bell 210. By means of a hose, which is inserted into the tube 206 for water filling and discharge when the sealing cap 203 for water feed and pressure relief is opened, in order to reach the tube centering device 207, the water-methanol mixture 76 is pumped out of the water tank 107 via the tube centering device 207.

FIG. 5 shows the tank system in operational condition. The water bell 210 was fixed to the sealing ring 209 for the water bell 210 and was pressed onto the sealing ring 209 both via the tube 206 for water filling and venting and via the fixing and triggering system 202. Thereby, the return spring 205 for the water bell 210 was tensioned.

The water bell 210 and the water container 107 are filled with water 7 with the sealing cap 203 open. Subsequently, the sealing cap 203 for water feed and pressure relief 203 is closed and the airbag system is activated.

The triggering unit is located on the methanol tank cover, at the upper end of the return spring 205. The triggering of the airbag system causes the fixing and triggering system to release from the upper side of the tank cover plate with stiffener 201, and to move upwards by means of the spring force of the return spring 205 for the water bell 210, which is fixed to the lower side of the tank cover plate with stiffeners 201 and to the upper side of the water bell 210. The water bell 210 follows this movement along the tube centering device 207. As a result, the water 7 contained in the water bell 210 and the water tank 107 arrives in the methanol tank 106 and dilutes the methanol 6 so much that it loses its ignition capacity. As a result of spring oscillations of the return spring 205, which are transmitted to the water bell 210, a mixture of methanol 6 and water 7 is rapidly formed into a water-methanol mixture 76. A pressure equalization system ensures that the pressure in the methanol tank 106 and in the water bell 210 are equal. Pressure equalization is an essential prerequisite for the functional efficiency of the fire protection apparatus. The bell tank can be used again after a triggering. For this purpose, the water-methanol mixture 76 must be removed from the methanol tank 106 and the water tank 107 and rinsed.

Bellows-Type Tank

Figure 6:
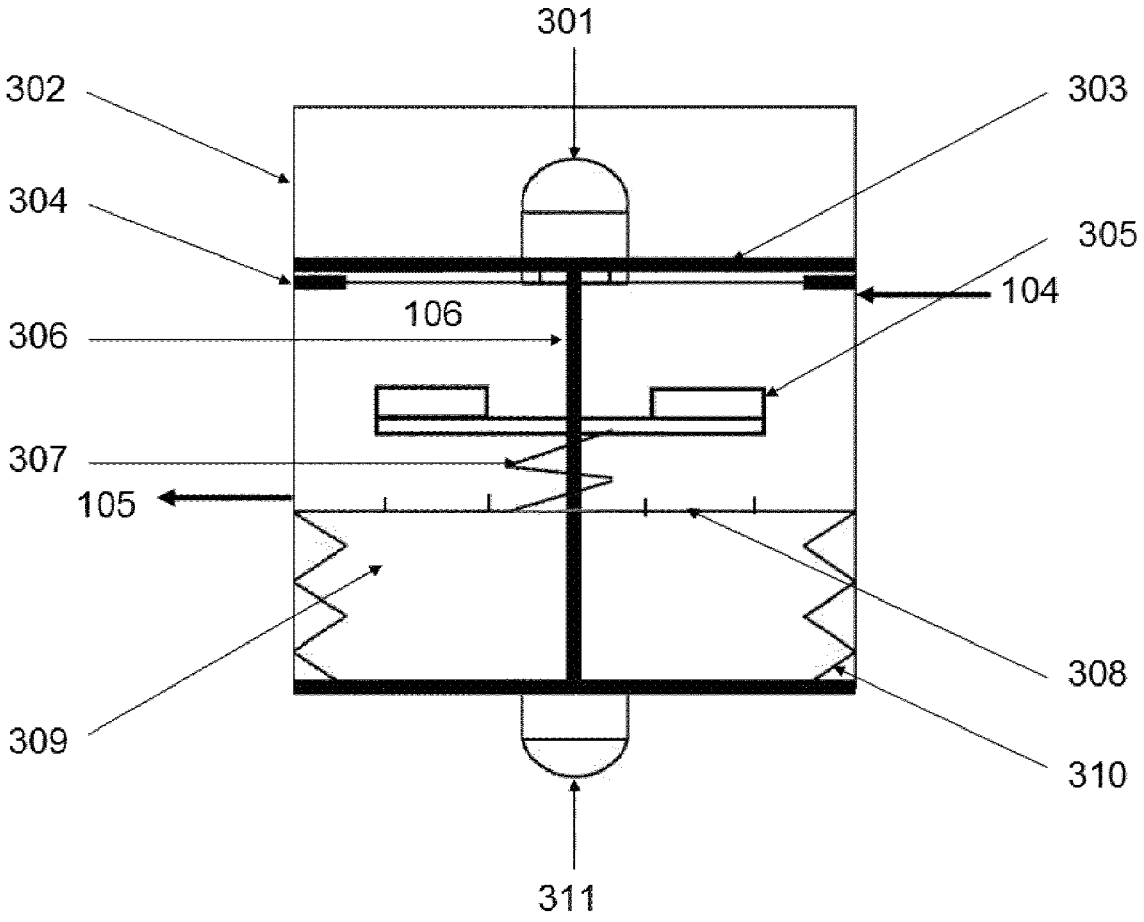
FIG. 6 a tank system (bellows-type tank) out of operation.
Figure 7:
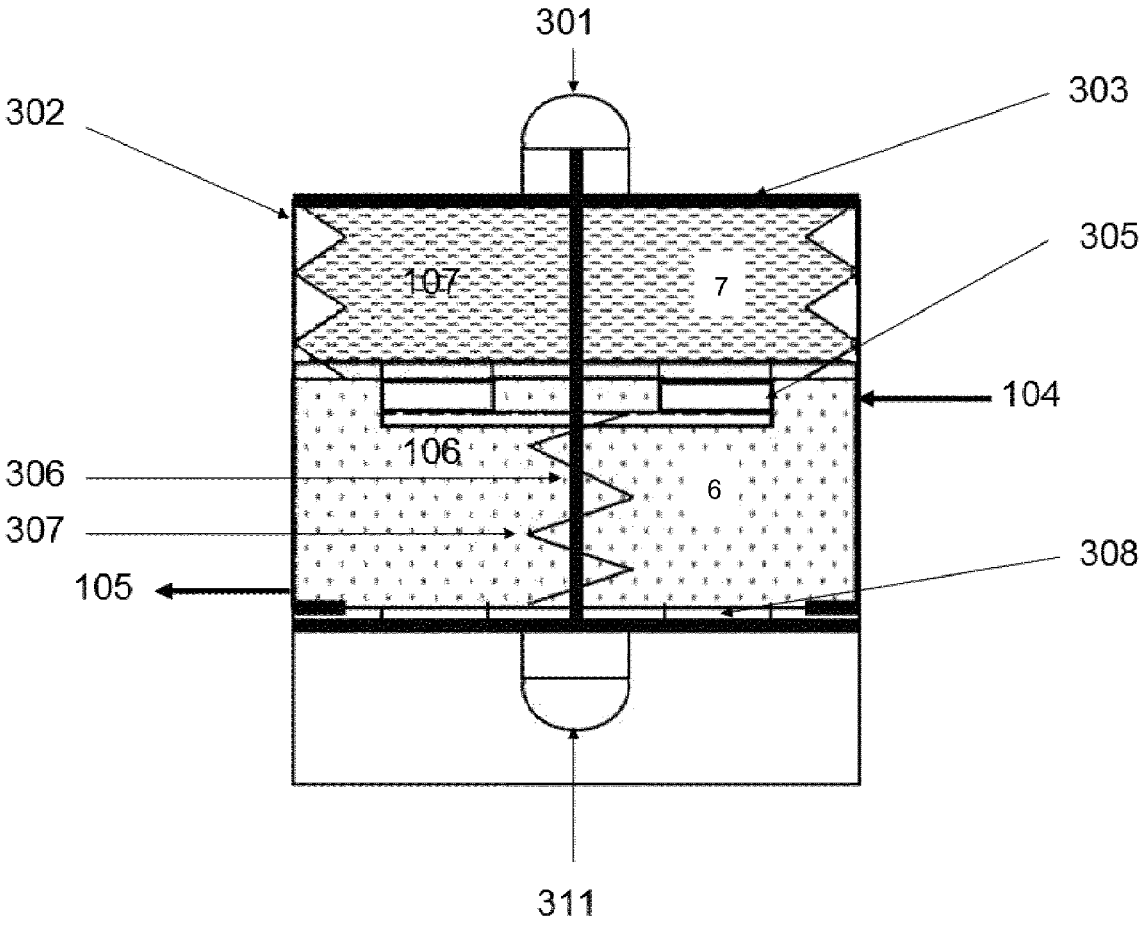
FIG. 7 a tank system (bellows-type tank) in operation.

An additional exemplary embodiment of a bellows-type tank is shown in FIGS. 6 and 7 with a bellows-type tank.

With the bellows-type tank, the methanol tank 106 is connected to the water tank 107 via a bellows system. The methanol tank 106 is located between two bellows units. The upper bellows 312 is used as a water tank 107 in normal operation, at maximum volume, filled with water 7 and tensioned. The lower bellows 309 is tensioned at minimum volume and is connected to the upper bellows 312 via a bellows connecting tube 306. The lower bellows 309 and the upper bellows 312 are tensioned during operation and released after a triggering. A bellows connecting tube 306 connects the lower bellows 309 with the upper bellows 312. The bellows connecting tube 306 has sealing units that seal the upper bellows 312 against the methanol tank 106 until an airbag signal causes the triggering. There are at least two openings 314 between the water tank 107 and the methanol tank 106. These are closed by a sealing plate 305, which is firmly connected to the bellows connecting tube 306 during operation. Between the methanol tank 106 and the lower bellows 309, there are at least two feedthroughs 308 that are sealed by a removable cover plate of the lower bellows 309. An airbag triggering unit and water filling system 301, which is arranged at an upper side of the water tank 107, and an airbag triggering unit and water-methanol mixture discharge system 311, which is arranged at a lower side of the methanol tank 106, are connected to each other and to a receiver of a control and activation unit via the bellows connecting tube 306. In the event of triggering, the tensioned spring of the upper bellows 312 is released and the bellows spring pushes the bellows connecting tube 306 in the direction of the lower bellows 309. This opens both the upper and lower seals to the methanol tank 106. Water 7 from the upper bellows 312 can now enter the methanol tank 106 and mix with methanol 6. Since, when an airbag is triggered, not only the upper spring release (upper bellows 312) but also the lower spring release (lower bellows 309) is activated, the resulting methanol-water mixture 76 is drawn into the lower bellows and collected there. The methanol-water mixture 76 can be pumped out via an adapter and an outlet opening on the lower bellows 309.

FIG. 6 shows the tank system after a triggering. From the upper bellows 312, only the cover plate 303, the bellows spring 304 (relaxed) along with the airbag triggering unit and water filling system 301 are visible. The upper bellows 312 and the lower bellows 309 are guided in a bellows guide 302 above and below the methanol tank 106. The cover plate 303 of the upper bellows 312 and the cover plate 313 of the lower bellows 309 are rigidly connected via the bellows connecting tube 306. A sealing plate 305 for at least two openings 314 from the upper bellows 312 to the methanol tank 106 is also firmly attached to the bellows connecting tube 306. The return spring 307 for the sealing plate 305 is fixed firmly to the lower side of the sealing plate 305 and to the upper side of the tank bottom of the methanol tank 106.

After the airbag triggering unit 311, which was locked in place on the lower side of the methanol tank 106 in a tensioned state, is triggered, the lower bellows 309, and here in particular the tensioned bellows spring 310, is released. The bellows connecting tube 306 moves in the direction of the lower bellows 309 and releases the openings 314 in the direction of the upper bellows 312. The released openings 314 were previously closed by the sealing plate 305. At the same time, feedthroughs 308 on the lower side of the methanol tank 106 are opened in the direction of the lower bellows 309 to the methanol tank 106, which were previously sealed by the cover plate of the lower bellows 309. Water 7 from the upper bellows 312 can now flow freely into the methanol tank 106, mix with methanol 6 and flow as a water-methanol mixture 76 into the lower bellows 309.

FIG. 7 shows the tank system in operational condition. The upper bellows 312 is a water tank 107 filled with water 7. The bellows spring 304 of the upper bellows 312 is tensioned. The airbag triggering unit and water-methanol mixture discharge system 311 (in short: airbag triggering unit 311) is locked in place on the lower side of the methanol tank 106. The bellows spring 310 of the lower bellows 309 is likewise tensioned. If the airbag and/or fire protective system is triggered, the airbag triggering unit 311, which serves to tension the bellows springs 304 and 310 and the return spring for sealing plates 307, is released from a mechanical catch from the lower side of the methanol tank 106. The spring forces of the upper bellows 312 and the lower bellows 309 along with the return spring 307 press water 7 from the upper bellows 312 (water tank 107) into the methanol tank 106 and further a water-methanol mixture 76 into the lower bellows 309.

Backup Power System

Figure 8A:
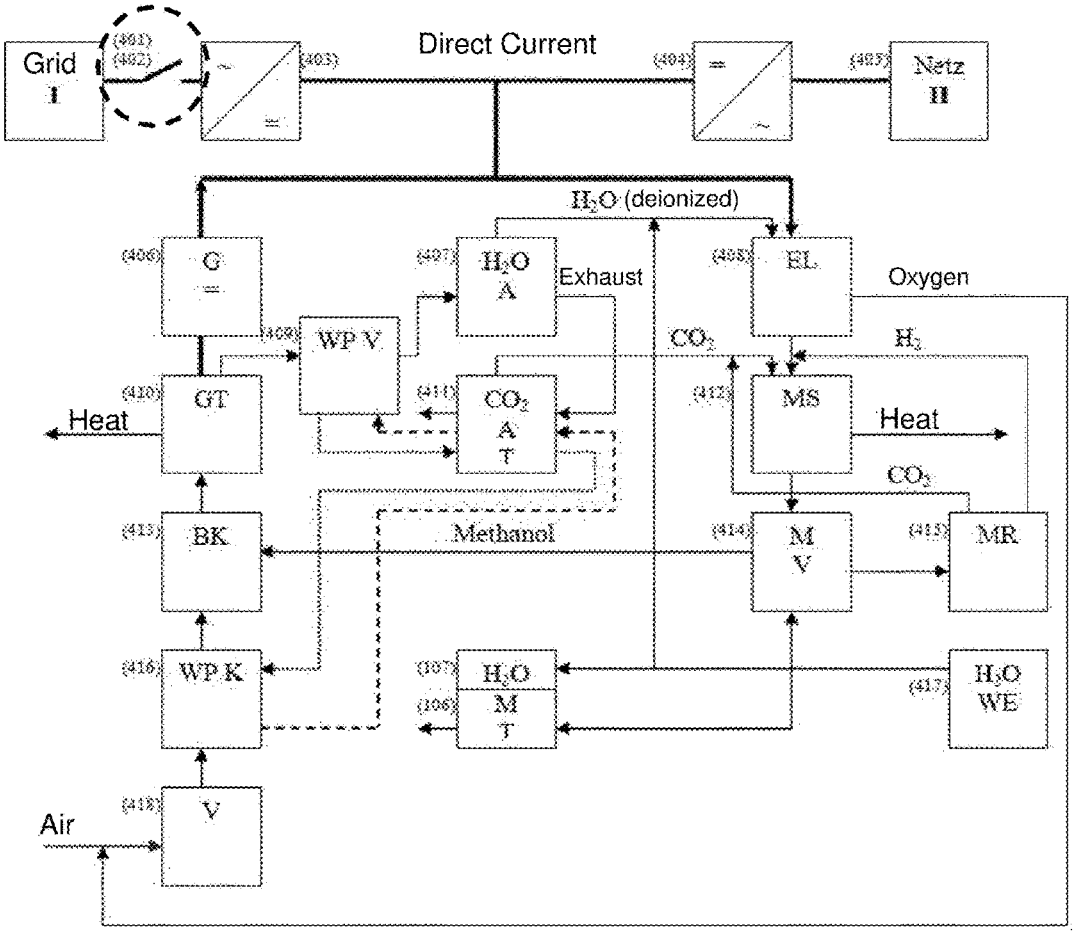
FIGS. 8*a*,8*b*,8*c*: a backup power system with tank system in operation.
Figure 8B:
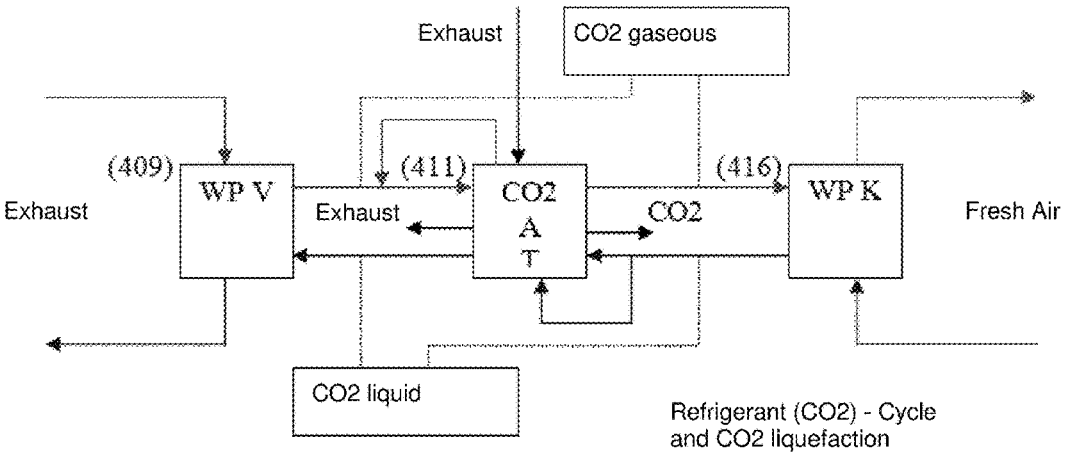
Figure 8C:
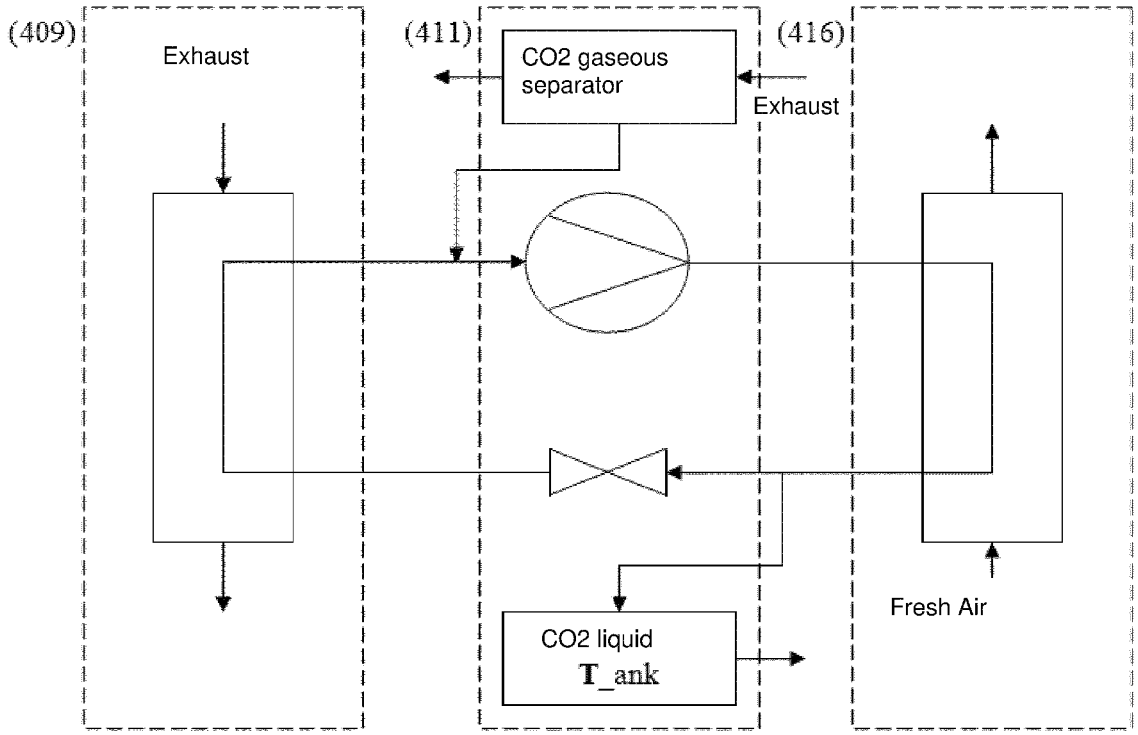
Figure 9:
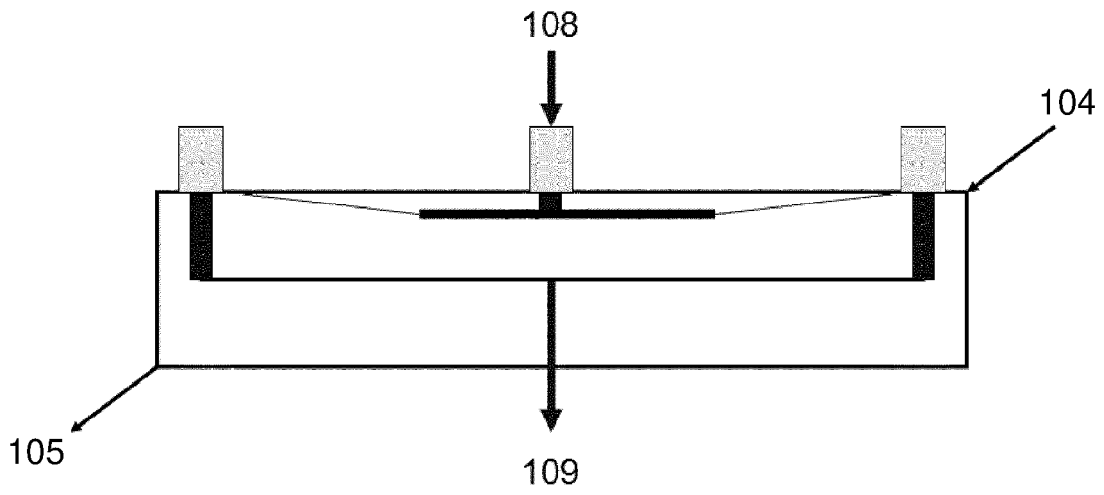
FIG. 9: a tank system (double-layer tank) with variable water storage of a backup power system.
Figure 10:
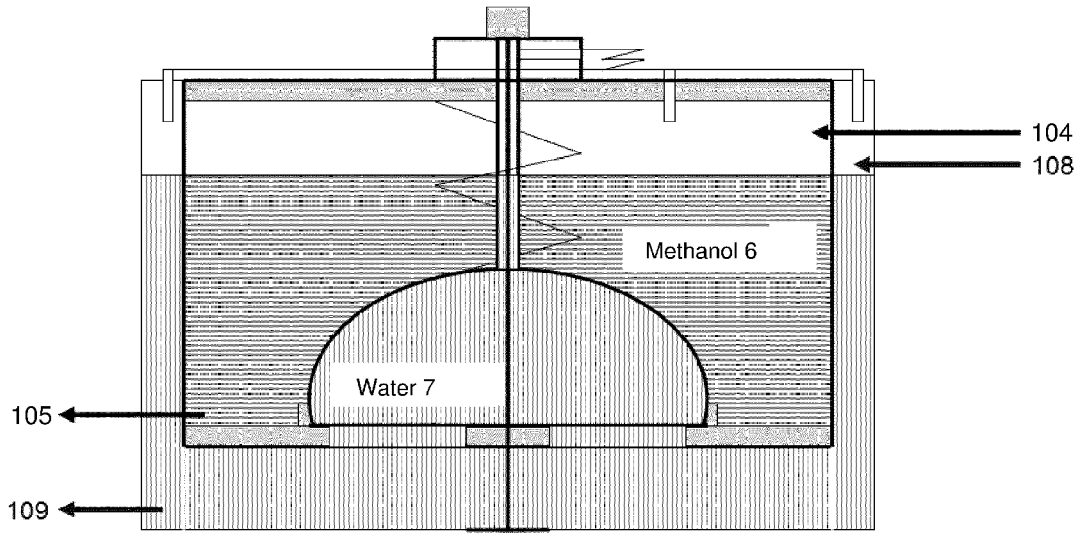
FIG. 10: a tank system (bell tank) with variable water storage of a backup power system.
Figure 11:
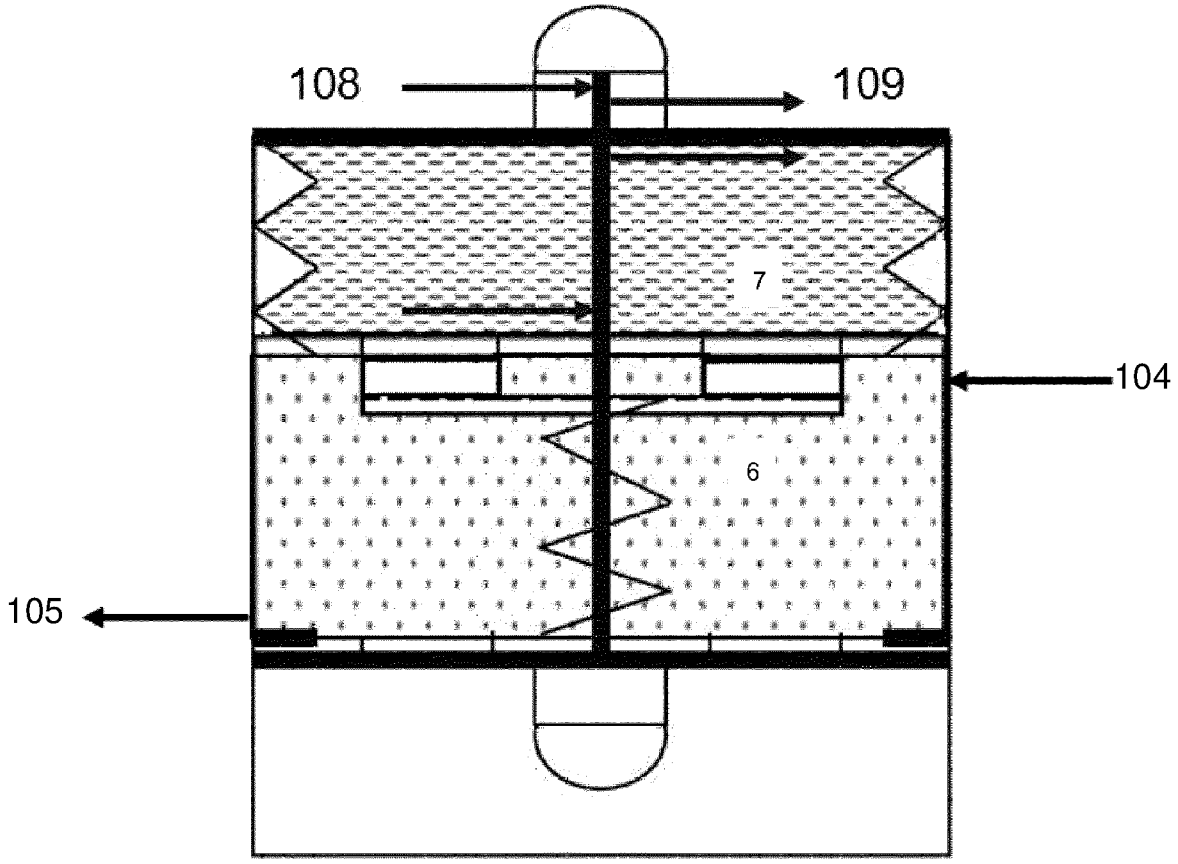
FIG. 11 a tank system (bellows-type tank) with variable water storage of a backup power system.

FIGS. 8*a*, 8*b* and 8*c* show, as an exemplary application, a backup power system with a tank system in operation and FIGS. 9 to 11 show the different tank systems in use with a backup power system. Tank systems constitute storage systems that can provide power in the event of a power failure. In combination with energy conversion plants, such as a methanol plant along with a power regeneration plant, it is possible to use tank systems very efficiently. In undisturbed operation, for example, it would be possible to store cheap excess electricity in tank systems by means of a methanol synthesis plant. In the event of a grid malfunction, which can result in the consumer being disconnected from the grid, the tank system and a power regeneration plant ensure that the consumer continues to be supplied with electricity. All media used in a backup power system can be used for the tank system. The main media used in a backup power system are water 7 and methanol 6.

The backup power system converts and stores electrical energy into chemical energy using a methanol storage system. The chemically stored energy is converted back into electrical energy by means of a fuel cell in the case of grid separation and/or by means of a turbine in the case of larger outputs. The backup power system corresponds to a stand-alone system operating in hot standby mode, by which extreme gradients in energy absorption and energy release can be realized. Thus, the electrolysis and the reconversion plant operate in hot standby mode at minimum power, which is used for self-supply. In the event of a grid interruption, the immediate shutdown of electrolysis ensures that the fuel cell or turbine is run at full capacity. After reaching full turbine capacity, the electrolysis plant is switched to hot standby mode. Since, in undisturbed operation, the backup power system stores energy that exceeds the amount required for an interruption in supply, the backup power system can also deliver methanol as fuel and assume an additional function as a filling station. It is irrelevant whether the electricity drawn from the generation grid comes from a renewable or conventional energy conversion plant.

The backup power system in FIG. 8*a* shows the tank system in operation. The tank system, consisting of a methanol tank 106 and a water tank 107, is filled via a methanol synthesis 412 and a methanol distributor 414. A methanol reformer 415 is used to maintain continuous methanol production. The methanol reformer 415 and an upstream electrolysis unit 408 are capable of producing hydrogen, which is chemically bound in the methanol synthesis 412 by adding carbon dioxide to methanol 6.

In addition to methanol production and storage, the backup power system also has a power regeneration plant, which constitutes a methanol consumer. An air compressor 418 compresses fresh air, which can also be mixed with electrolysis oxygen from electrolysis 408. In a condenser of a heat pump 416, heat from the exhaust gas of a gas turbine 410 is added to the fresh air. The heat from the exhaust gas is absorbed by the evaporators of a heat pump 409 and a CO2 separator 411 and is fed to the condenser of the heat pump 416 via a compressor in the CO2 separator 411 (FIGS. 8*b* and 8*c*). Here, the refrigerant, for example CO2, is expanded after the heat release in the condenser via an expansion valve in the CO2 separator 411 and is transferred to the evaporator of the heat pump 409 and the CO2 separator 411. The heated fresh air is fed into a combustion chamber 413, where it is mixed with methanol 6 and ignited. The hot exhaust gas drives one or more turbine wheels of a gas turbine 410. The gas turbine 410 is coupled with a generator 406. Here, the torque generated by the gas turbine 410 is converted into electrical energy. The electrical energy is available as direct current and can now be supplied directly to the consumer via consumer grid II 405. If there is no demand from the consumer in consumer grid II 405, the energy generated could also be fed back into the supplying grid I 401 via the circuit breaker 402 (switching state of "On").

The backup power system has numerous auxiliary facilities that serve to store intermediate products such as water 7, CO2 and methanol 6. Water 7 of the best quality, also known as deionized water, is extracted from the exhaust gas of the gas turbine 410 via the water separator 407 and is fed into the water tank 107. As an alternative to the gas turbine generator set (418, 416, 413, 410 and 406), a methanol fuel cell can also be used. The resulting reaction products are similar and can also be used for water recovery through a water separator 407.

The CO2 required for methanol synthesis is primarily obtained from the exhaust gas of the gas turbine or fuel cell. Thereby, CO2 is extracted via a membrane. The gaseous CO2 is compressed to such a high level that it can be fed into the refrigeration circuit of the heat pump 409, specifically in the gas phase. In return, liquid CO2 is extracted from the heat pump 409 and temporarily stored in a storage device.

In the event that the power regeneration plant is not in operation and carbon dioxide and hydrogen (CO2 and H2) are not sufficiently available for methanol synthesis, CO2 and H2 can also be produced by a methanol reformer 415.

The tank used in backup power systems is a combination of a methanol tank 106 and a water tank 107. Both media can be stored either in a double-layer, bell or bellows-type tank solution. The backup power system for converting and storing electrical energy into chemical energy by means of a methanol storage unit is connected to a tank system that contains at least one double-layer tank and/or at least one bell tank and/or at least one bellows-type tank. The water 7 obtained from the exhaust gas of a gas turbine 410 is fed to the water tank 107 of the tank system via a water separator 407 of the backup power system. In the event of a malfunction (fire), protective systems are activated, which lead to a reduction in the ignition capacity of the methanol 6.

FIG. 9 shows a tank system (double-layer tank) with variable water storage of a backup power system. The water tank 107 is now charged or discharged depending on the methanol level in the methanol tank 106. The water tank 107 constitutes a buffer for the water softening unit or deionized water production 417. The deionized water produced for the electrolysis can be obtained either directly from the deionized water production 417, from the water tank 107 or the water separator 407. The variable water feed 108 to the water tank 107 of the backup power system and the variable water discharge 109 from the water tank 107 of the backup power system are adjustable.

FIG. 10 shows a tank system (bell tank) with variable water storage 107 of a backup power system. The mode of operation corresponds to that of the double-layer tank.

FIG. 11 shows a tank system (bellows-type tank) with variable water storage 107 of a backup power system.

REFERENCE SIGNS

General
- 6 Methanol
- 7 Water
- 76 Water-methanol mixture
- 104 Methanol feed to methanol tank 106
- 105 Methanol discharge
- 106 Methanol tank
- 107 Water tank
- 108 Water feed to the water tank 107 of the backup power system
- 109 Water discharge from the water tank 107 of the backup power system Double-Layer Tank
- 100 Rubber membrane
- 101 Bulkhead triggering unit with bulkheads
- 102 Punch triggering unit with punch and rubber membrane
- 103 Air chamber Bell Tank
- 201 Tank cover plate with stiffening
- 202 Airbag control, fixing and triggering system
- 203 Sealing cap for water feed and pressure relief
- 204 Pressure equalization system
- 205 Return spring for water bell
- 206 Tube for water filling and venting
- 207 Tube centering device
- 208 Tank bottom with stiffening
- 209 Sealing ring for water bell
- 210 Water bell Bellows-Type Tank
- 301 Airbag triggering unit and water filling system
- 302 Bellows guide above and below the methanol tank
- 303 Cover plate of upper bellows 312
- 304 Bellows spring of the upper bellows (relaxed)
- 305 Sealing plate for feedthroughs of the upper bellows to the methanol tank
- 306 Bellows connecting tube
- 307 Return spring for sealing plate
- 308 Feedthrough of lower bellows to the methanol tank
- 309 Lower bellows
- 310 Bellows spring of lower bellows, relaxed
- 311 Airbag triggering unit and water-methanol mixture discharge system
- 312 Upper bellows
- 313 Cover plate of the lower bellows 309
- 314 Openings in the direction of the upper bellows 312

Backup Power System
- 401 Grid I, e.g. supplying grid (e.g. three-phase supply grid)
- 402 Circuit breaker (normal operation—On; malfunction—Off)
- 403 Power converter, e.g. in rectifier mode

404 Power converter, e.g. in inverter mode
405 Grid II, e.g. consumer grid
406 Direct current generator or fuel cell, generator
407 Water separator
408 Electrolysis unit, electrolysis
409 Heat pump V (evaporator, heat absorption of exhaust gas heat)
410 Gas turbine
411 CO2 separator
412 Methanol synthesis
413 Gas turbine combustion chamber, combustion chamber
414 Methanol distributor
415 Methanol reformer
416 Heat pump K (condenser, heat output to fresh air)
417 Deionized water production (water softening)
418 Compressor, air compressor

The invention claimed is:

1. A method, comprising:

providing a methanol tank (106) filled with pure methanol (6) and a water tank (107) filled with water (7);

releasing, in response to a control signal from an airbag system and/or a fire warning system, the water (7) from the water tank (107) into the methanol tank (106); and thereby creating a water-methanol mixture (76) within the methanol tank (106) having material properties which fall below an effective ignition limit.

2. The method according to claim 1, further comprising:

sending the control signal, at the same time that the airbag system and/or the fire warning system is triggered, to a receiver of a control and activation unit of the tank, wherein the water tank (107) is arranged in an upper half of the methanol tank (106), and wherein at least two bulkhead triggering units (101) with integrated bulkheads are in operative connection with both the methanol tank (106) and the water tank (107), and wherein a punch triggering unit (102) in operative connection with the water tank (107), and wherein the bulkhead triggering units (101) and the punch triggering unit (102) are activated by the control signal, which causes the water (7) from the water tank (107) to flow into the methanol tank (106) through the integrated bulkheads.

3. The method according to claim 2, wherein, when the bulkhead triggering units (101) are activated, the water tank (107) is opened by the integrated bulkheads and the water (7) flows into the methanol tank (106), and wherein at the same time a flat, horizontal rubber membrane (100), which divides the water tank (107) into two areas and is movably arranged in the water tank (107) and connected to the punch triggering unit (102), is pressed against a tank bottom of the water tank (107) by the punch triggering unit (102), in order to accelerate an outflow of the water (7).

4. The method according to claim 3, wherein the integrated bulkheads seal the water tank (107) against the methanol tank (106) and the horizontal rubber membrane (100) is relaxed during operation.

5. The method according to claim 1, further comprising:

sending the control signal, at the same time that the airbag system and/or the fire warning system is triggered, to a receiver of a control and activation unit, wherein the methanol tank (106) is arranged in the water tank (107), wherein a water bell (210) is filled with water (7) and has a connection to the water tank (107), the water bell being arranged in a vertically movable manner as a vertically oscillating system in the methanol tank (106), and wherein a fixing and triggering system (202) is provided which, when activated, causes the water (7) from the water tank (107) and the water bell (210) to flow into the methanol tank (106).

6. The method according to claim 5, wherein the water bell (107) is centrally guided along a tube centering device (207) which is firmly connected to a tank bottom of the water tank (107) and to a bottom of the methanol tank (106), and which moves vertically in the methanol tank (106), and wherein a return spring (205) between a tank cover plate (201) of the methanol tank (106) and an upper side of the water bell (210) causes the water bell (210) to vibrate vertically along the tube centering device (207) when the fixing and triggering system (202) is activated.

7. The method according to claim 1, further comprising:

sending the control signal, at the same time that the airbag system and/or the fire warning system is triggered, to a receiver of a control and activation unit, wherein a bellows tank is provided which comprises an upper bellows (312) forming the water tank (107), the methanol tank (106), and a lower, normally contracted bellows (309), wherein the upper bellows (312), the methanol tank (106) and the lower bellows (309) are arranged above one another and connected by a bellows connecting tube (306), wherein an airbag triggering unit (301) which is arranged on an upper side of the water tank (107) and an airbag triggering unit (311) which is arranged on a lower side of the methanol tank (106) are activated, in order to direct the water (7) from the water tank (107) into the methanol tank (106).

8. The method according to claim 7, wherein, after activation of the airbag triggering unit (311), the lower bellows (309) is released by moving the bellows connecting tube (306) towards the lower bellows (309), wherein at least two openings (314) between the water tank (107) and the methanol tank (106) and at least two feedthroughs (308) between the methanol tank (106) and the lower bellows (309) are released, such that the water (7) flows from the upper bellows (312) into the methanol tank (106), mixes with the methanol (6) and flows as the water-methanol mixture (76) into the lower bellows (309).

9. The method according to claim 1, wherein the methanol tank (106) is connected to a backup power system for converting and storing electrical energy into chemical energy.

10. The method as in claim 1, wherein the methanol tank (106) is arranged within a vehicle having a methanol-based drive system.

11. The method as in claim 1, wherein the methanol tank (106) is connected to a power system for converting and storing electrical energy into chemical energy by methanol storage.

12. A double-layer tank, comprising:

a methanol tank (106) filled with pure methanol (6) and a water tank (107) filled with water (7), wherein the water tank (107) is arranged in an upper half of the methanol tank (106) and wherein the methanol tank (106) and the water tank (107) together form the double-layer tank, wherein at least two bulkhead triggering units (101) with integrated bulkheads are in operative connection both with the methanol tank (106) and with the water tank (107) and wherein a punch triggering unit (102) is in operative connection with the water tank (107), and wherein the bulkhead triggering units (101) and the punch triggering unit (102) are connected to a control and activation unit, and wherein a flat, horizontal rubber membrane (100) divides the water tank (107) into two areas and is movably arranged in the water tank (107) and connected to the punch triggering unit (102), and wherein, in response to a control signal from an airbag system and/or a fire warning system, the water (7) from the water tank (107) is released into the methanol tank (106), thereby creating a water-methanol mixture (76) in the double-layer tank having material properties which fall below an effective ignition limit.

13. A tank system for methanol fuels with a fire protection apparatus, comprising:

a methanol tank (106) filled with pure methanol (6); and a water tank (107) filled with water (7), wherein the methanol tank (106) is arranged in the water tank (107) in such a manner that the methanol tank (106) is surrounded by the water (7), and wherein a water bell (210), filled with water (7), is arranged in the methanol tank (106) and is connected in a sealed manner to a bottom of the methanol tank (106), and wherein the water bell (210) has an open connection to the water tank (107) by feedthroughs in the bottom of the methanol tank (106), and wherein the water bell (107) is arranged in a vertically movable manner in the methanol tank (106) along a tube for water filling and venting (206), and wherein a fixing and triggering system (202) is connected to a control and activation unit, and wherein the fixing and triggering system (202) is connected to the water bell (210) via the tube for water filling and venting (206), wherein, in response to a control signal from an airbag system and/or a fire warning system, the water (7) from the water tank (107) is released into the methanol tank (106), thereby creating a water-methanol mixture (76) within the methanol tank (106) having material properties which fall below an effective ignition limit.

14. The tank system according to claim 13, wherein, in the tube for water filling and venting (206), a tube centering device (207) is firmly connected to a tank bottom of the water tank (107) and to a bottom of the methanol tank (106), such that the water bell (210) is centrally guided, and wherein a return spring (205) is arranged between a tank cover plate (201) of the methanol tank (106) and an upper side of the water bell (210).

15. A bellows tank, comprising:

a methanol tank (106) filled with pure methanol (6); and a water tank (107) filled with water (7), wherein the methanol tank (106) is connected to the water tank (107) via a bellows system, wherein the water tank (107) is arranged in an upper bellows (312) above the methanol tank (106) and a lower bellows (309) is arranged below the methanol tank (106), which are tensioned during normal operation and relaxed after a triggering, and wherein a bellows connecting tube (306) connects the lower bellows (309) to the upper bellows (312), and wherein at least two openings (314) are arranged between the water tank (107) and the methanol tank (106), which are closed by a sealing plate (305) during operation, and wherein at least two feedthroughs (308) are arranged between the methanol tank (106) and the lower bellows (309), which are sealed by a removable cover plate of the lower bellows (309), and wherein an airbag triggering unit and water filling system (301), which is arranged at an upper side of the water tank (107), and an airbag triggering unit and water-methanol mixture discharge system (311), which is arranged on a lower side of the methanol tank (106), are connected to each other and to a control and activation unit via the bellows connecting tube (306), and wherein the sealing plate (305) is firmly connected to the bellows connecting tube (306), by which the openings (314) are opened by the airbag triggering units (301, 311) in case of a fire, wherein, in response to a control signal from an airbag system and/or a fire warning system, the water (7) from the water tank (107) is released into the methanol tank (106), thereby creating a water-methanol mixture (76) in the bellows tank having material properties which fall below an effective ignition limit.

16. The bellows tank according to claim 15, wherein the methanol tank (106) is arranged in a housing that, in its extension above and below the methanol tank (106), presents a bellows guide (302) for the upper bellows (312) and the lower bellows (309).

17. The bellows tank according to claim 15, wherein the sealing plate (305) is firmly connected at its lower side to a return spring (307), which is firmly connected at its opposite end to a tank bottom of the methanol tank (106).

* * * * *